US005174355A

United States Patent [19]

Nelson

[11] Patent Number: 5,174,355

[45] Date of Patent: Dec. 29, 1992

[54] METHOD FOR DETECTING CASTING ALIGNMENT DEFECTS

[76] Inventor: Thomas R. Nelson, 15050 W. North Ave., Brookfield, Wis. 53005

[21] Appl. No.: 740,935

[22] Filed: Aug. 6, 1991

[51] Int. Cl.[5] ..... B22D 46/00

[52] U.S. Cl. ..... 164/4.1; 164/150

[58] Field of Search ..... 164/4.1, 150

[56] References Cited

U.S. PATENT DOCUMENTS 3,496,766 2/1970 Stein ..... 164/4.1
4,469,164 9/1984 Ishikawa et al. ..... 164/457
4,538,669 9/1985 Markarian et al. ..... 164/451
4,724,886 2/1988 Sjodahl ..... 164/4.1

*Primary Examiner*—Kuang Y. Lin
*Attorney, Agent, or Firm*—Joseph S. Heino

[57] ABSTRACT

A shift detecting element originates from an element cavity, a portion of which is defined in one portion of a mold section and another portion of which is defined in another cooperating mold section. The detecting element is cast as an appurtenance to a principal casting and is configured such that it can be easily removed from the principal casting. Misalignment or separation is determined by inspection and/or measurement of the cast shift detecting element.

9 Claims, 2 Drawing Sheets

FIG. 1.
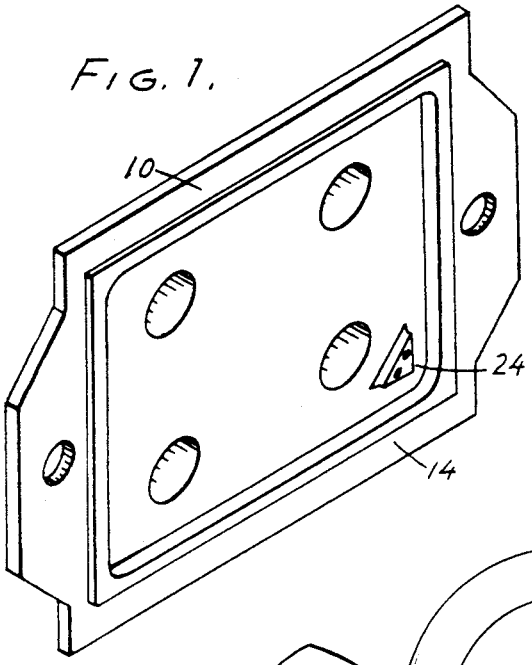
FIG. 2.
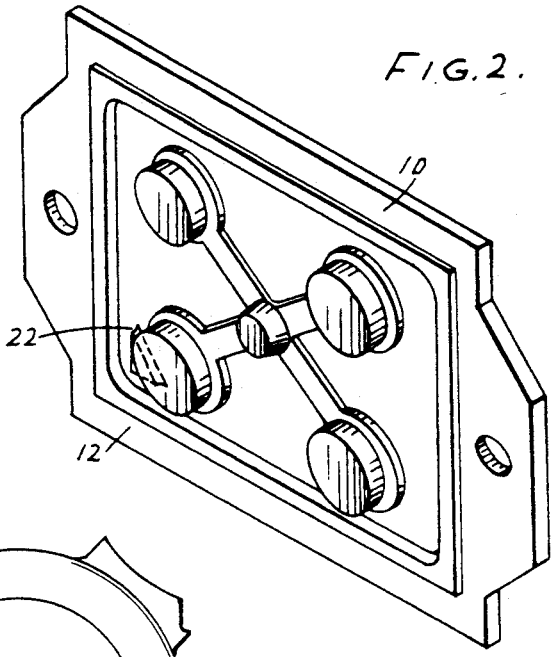
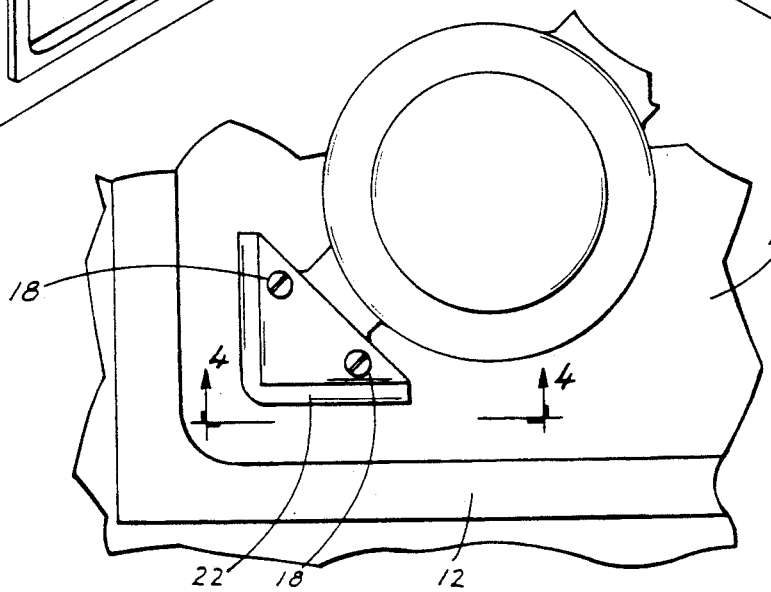
FIG. 3.
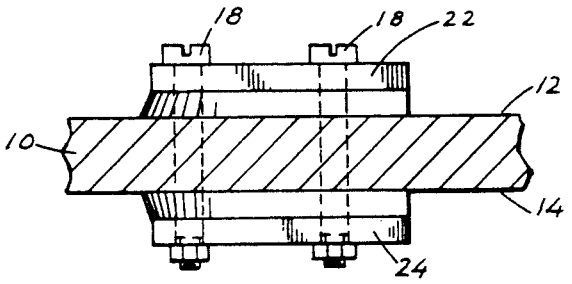
FIG. 4.

FIG. 5.
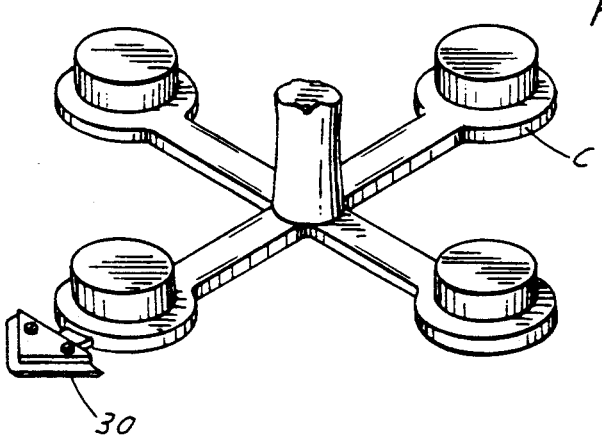
FIG. 6.
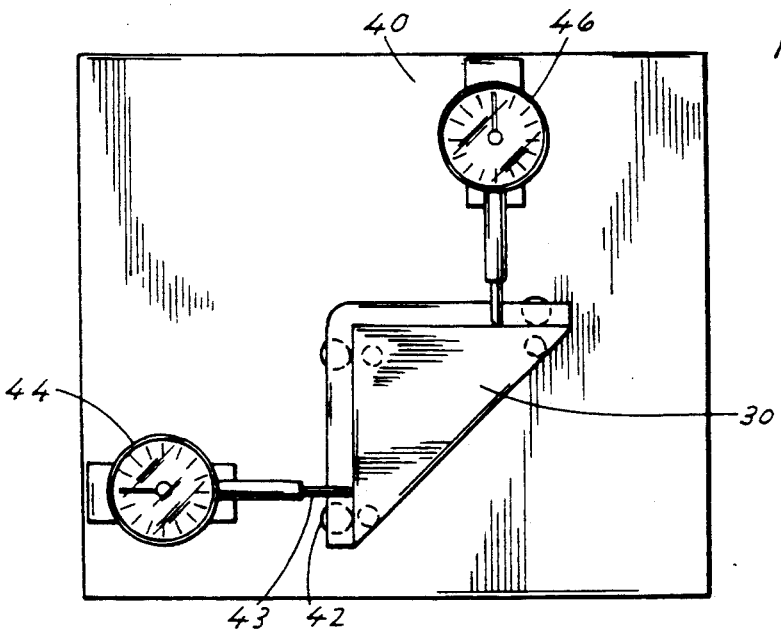
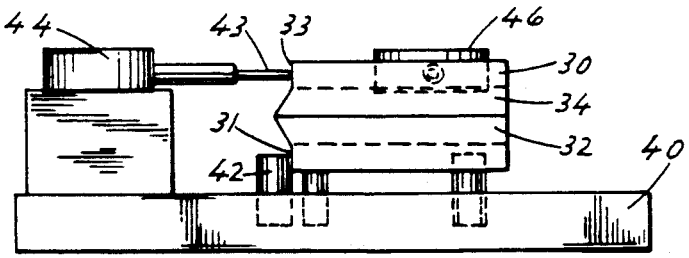
FIG. 7.

METHOD FOR DETECTING CASTING ALIGNMENT DEFECTS

FIELD OF THE INVENTION

The present invention relates to methods for inspecting castings. More particularly, it relates to a method for detecting and measuring alignment defects in oppositely situated portions of a casting mold or pattern.

BACKGROUND OF THE INVENTION

In the foundry industry, it is well recognized that cooperating mold sections must remain aligned so that a correctly formed molding or casting can be produced when the mold cavity is filled with molten metal. If, during the process of forming the cooperating mold sections or during the metal filling process, the cooperating mold sections become misaligned or separated the molding or casting will likely be improperly formed. The resulting casting will often be outside of manufacturing tolerances and, as such, unusable.

It has also been recognized in the foundry industry that a problem exists in detecting and in measuring the amount of any such misalignment or separation of the cooperating mold sections. A conventional method for detecting any such molding misalignment or separation is to take a sampling of the resulting molded products or moldings and to simply measure them for such misalignment or separation. However, due to the shape or configurations of such molds, it is often not feasible to measure each and every such casting resulting from it. The shape or configuration of the casting may lend itself to difficulties in determining whether any misalignment or separation has occurred during the process. More importantly, the particular shape or configuration involved may make it extremely difficult, if not impossible in some cases, to accurately measure the amount of misalignment or separation which has occurred to determine whether a tolerance has been met or violated.

SUMMARY OF THE INVENTION

It is, therefore, a principal object of the present invention to provide a method for detecting mold section misalignment and/or separation which results in a significant reduction of the time and effort which is presently involved when measuring castings for such misalignment or separation defects and which results in greater detection accuracy. It is another object of the present invention to provide such a method without involving complex and costly equipment and materials and which makes such a method economically feasible for virtually all foundry settings.

The method of the present invention has obtained these objects. It provides for a shift detecting element which is cast as an appurtenance to a principal casting, such casting assuming almost any shape or size. The shift detecting element originates from an element cavity, a portion of which is defined in one portion of a mold section and another portion of which is defined in another cooperating mold section. The appurtenant shift detecting element is configured such that it can be easily removed from the principal casting. Misalignment or separation can be determined relatively easily separation by visual inspection of the cast shift detecting element. More accurate tolerances are determined by placing the cast shift detecting element in a measuring device to determine whether even slight mold section misalignment or separation has occurred prior to or during the casting process. The foregoing and other features of the method of the present invention will be further apparent from the description which follows.

BRIEF DESCRIPTION OF THE DRAWINGS

FIG. 1 is a perspective view of a molding match plate showing the drag half thereof.

FIG. 2 is a perspective view of the molding match plate of FIG. 1 showing the cope half thereof.

FIG. 3 is a close-up fragmentary top plan view of the match plate shown in FIG. 2 and showing a shift detecting element affixed thereto.

FIG. 4 is a sectional view of the match plate and shift detecting element taken along line 4—4 of FIG. 3.

FIG. 5 is a perspective view of the resulting casting and shift detecting element cast therewith.

FIG. 6 is a top plan view of an apparatus used to measure mold section misalignment in the shift detecting element.

FIG. 7 is a side elevational view of the measuring apparatus and shift detecting element shown in FIG. 6.

DETAILED DESCRIPTION

Referring now to the drawings in detail, FIGS. 1 and 2 show the two sides of a match plate 10. In the preferred embodiment, the match plate 10 is provided with a cope side 12 and a drag side 14. While the match plate shown depicts a specific mold pattern, it is understood that the mold pattern can assume an infinite variety of shapes and sizes and is for illustrative purposes only in the preferred embodiment. It is also understood that other configurations of male and female mold halves, sections or separate cope, separate drag patterns and match plates can be used.

The cope side 12 of the match plate 10 of the preferred embodiment is provided with a first shift detecting element 22. As shown in FIG. 3, the first shift detecting element 22 is attached to the cope side 12 of the match plate 10 by fasteners 18 which pass through holes in the shift detecting element 22 and the match plate 10 (not shown). A second shift detecting element 24 which is complimentary to the first shift detecting element 22 is attached to the drag side 14 of the match plate 10. The first and second shift detecting elements 22, 24 are placed in complimentary position so as to be aligned opposite each other on opposite halves of the match plate 10. See FIG. 3. FIG. 4 shows the shift detecting elements 22, 24 as they are attached to the match plate 10 from both sides thereof.

In application, the drag side 14 of the match plate 10 is placed onto a drag flask. The drag flask is then inverted and filled with sand. The same process is followed with respect with the cope side 12 of the match plate 10 and a cope flask. The sand is then compacted, a sprue hole for molding purposes is cut into the sand and then the match plate 10 is removed from between the cope and drag flasks. The impression of the shift detecting elements 22, 24 is left in the sand of each flask and forms a shift detecting element cavity therein. The mold is then poured with molten metal and the resulting casting C is removed from the flasks. See FIG. 5.

The final mold casting C can be seen to contain as an appurtenance, or a side portion thereof, a cast shift detecting element 30. Visual inspection of the cast shift detecting element 30 will give the user a preliminary indication of any misalignment or separation which may have occurred prior to or during the casting process.

The cast shift detecting element 30 is then removed from the casting C and placed on the measuring apparatus 40. See FIG. 6. With the cast shift detecting element 30 in place the precise amount of misalignment or separation, if any, can then be measured relatively precisely and for virtually any casting. The measuring apparatus 40 has a locator 42 against which the shoulder 31 of the drag side 32 of the cast shift detecting element 30 is situated. The cope side 34 of the cast shift detecting element 30 also has a shoulder 33 against which the foot 43 of a measuring device 44 is pressed. See FIG. 7. The amount of deflection shown in the measuring device 44 is a direct measurement of the misalignment, if any, that occurred in that lateral direction. Another measuring device 46 is provided which makes a similar measurement in the other lateral direction of the cast shift detecting element 30. The measuring device can also measure for angular displacement of the mold sections as well as overall thickness of the cast shift detecting element which would indicate incomplete or improper closure of the mold sections.

From the foregoing description of the illustrative embodiment for carrying out the method of the present invention it will be apparent that there has been provided a method for detecting and measuring alignment or separation defects in oppositely situated portions of a casting mold pattern. It is intended that the invention not be limited to the particular embodiment disclosed, but that the invention will include all embodiments falling within the scope of the subjoined claims.

The principles of this invention having been fully explained in connection with the foregoing, I hereby claim as may invention:

1. A method for detecting misalignment or separation of cooperating mold sections which comprises the steps of forming cooperating mold sections, forming a product mold cavity within said cooperating mold sections, forming a detecting element cavity within said cooperating mold sections, casting a product within said cooperating mold sections, casting a detecting element within said cooperating mold sections, removing said detecting element from said cooperating mold sections, and measuring said detecting element with a measuring means whereby an misalignment or separation of said cooperating mold sections is detected and measured.

2. The method of claim 1, including, prior to said element measuring step, the step of visually inspecting said detecting element.

3. The method of claim 2 wherein said mold section forming step comprises forming cooperating male and female mold halves.

4. A method for detecting misalignment or separation of cooperating mold sections which comprises the steps of forming a first mold section to define and to form a product mold cavity therewithin, forming a second mold section, said second mold section being functionally adapted to cooperate with said first mold section, locating a product mold cavity and a shift detecting element cavity within said mold sections, defining said product mold cavity and said shift detecting element cavity within said mold sections, casting said product and said shift detecting element within said shift detecting element cavity, removing said product and said shift detecting element from said mold sections, and measuring said detecting element with a measuring apparatus whereby any misalignment or separation of said mold sections is detected and measured.

5. The method of claim 4, including, prior to said element measuring step, the step of visually inspecting said detecting element.

6. The method of claim 5 wherein said first mold section forming step comprises forming a male mold half and said second mold section forming step comprises forming a female mold half.

7. A method for detecting misalignment or separation of cooperating mold sections which comprises the steps of forming cooperating mold sections, forming an interior cavity within said mold sections, a portion of said interior cavity defining the outer surface of a product mold cavity and portion defining the outer surface of a detecting element, casting a product and a detecting element within said interior cavity, removing said detecting element from said mold sections, and biasing said detecting element against a measuring device whereby any misalignment or separation of said cooperating mold sections is detected and measured.

8. The method of claim 7, including, prior to said element measuring step, the step of visually inspecting said detecting element.

9. The method of claim 8 wherein said mold section forming step comprises forming cooperating male and female mold halves.

* * * * *